US011871884B2

(12) United States Patent
Guo et al.

(10) Patent No.: US 11,871,884 B2
(45) Date of Patent: Jan. 16, 2024

(54) PORTABLE VACUUM CLEANER

(71) Applicant: DREAME INNOVATION TECHNOLOGY (SUZHOU) CO., LTD., Suzhou (CN)

(72) Inventors: Zhenke Guo, Suzhou (CN); Ru Zhang, Suzhou (CN)

(73) Assignee: DREAME INNOVATION TECHNOLOGY (SUZHOU) CO., LTD., Suzhou (CN)

( * ) Notice: Subject to any disclaimer, the term of this patent is extended or adjusted under 35 U.S.C. 154(b) by 23 days.

(21) Appl. No.: 17/638,817

(22) PCT Filed: Nov. 22, 2019

(86) PCT No.: PCT/CN2019/120426
§ 371 (c)(1),
(2) Date: Feb. 26, 2022

(87) PCT Pub. No.: WO2021/036042
PCT Pub. Date: Mar. 4, 2021

(65) Prior Publication Data

US 2022/0304531 A1 Sep. 29, 2022

(30) Foreign Application Priority Data

Aug. 30, 2019 (CN) ..... 201910816192.6

(51) Int. Cl.
*A47L 9/16* (2006.01)
*A47L 9/20* (2006.01)

(52) U.S. Cl.
CPC ..... *A47L 9/1683* (2013.01); *A47L 9/1608* (2013.01); *A47L 9/1691* (2013.01); *A47L 9/20* (2013.01)

(58) Field of Classification Search
CPC .... A47L 9/1683; A47L 9/1608; A47L 9/1691; A47L 9/20; A47L 9/16; A47L 5/24
See application file for complete search history.

(56) References Cited

U.S. PATENT DOCUMENTS 7,351,269 B2 * 4/2008 Yau ..... A47L 9/20 55/296
2007/0271724 A1 11/2007 Hakan et al.
(Continued)

FOREIGN PATENT DOCUMENTS

CN 205493717 U 8/2016
CN 206434272 U 8/2017
(Continued)

*Primary Examiner* — Don M Anderson
*Assistant Examiner* — Christopher Soto
(74) *Attorney, Agent, or Firm* — Cheng-Ju Chiang

(57) ABSTRACT

A portable vacuum cleaner includes a housing and a filter assembly. The housing includes a dust collecting cylinder, a dust blocking cover and a main body. The dust collecting cylinder is opened to form an air inlet port and a mating port. The dust blocking cover is rotatably connected to the air inlet port of the dust collecting cylinder. The main body is detachably connected to the mating port of the dust collecting cylinder. A two-way locking structure is provided between the dust blocking cover and the main body. The two-way locking structure is adapted to lock or unlock the dust blocking cover and the main body simultaneously with the dust collecting cylinder, so that when the two-way locking structure is in a locked state, the dust blocking cover cannot open the air inlet port, while the dust collecting cylinder and the main body cannot be separated.

10 Claims, 5 Drawing Sheets

(56) References Cited

U.S. PATENT DOCUMENTS

| | | | | |
|---|---|---|---|---|
| 2019/0090701 | A1 | 3/2019 | Tonderys et al. | |
| 2019/0282049 | A1* | 9/2019 | Conrad | A47L 9/1409 |
| 2019/0290082 | A1 | 9/2019 | Conrad | |
| 2021/0290020 | A1 | 9/2021 | Tonderys et al. | |

FOREIGN PATENT DOCUMENTS

| | | | |
|---|---|---|---|
| CN | 206581711 | U | 10/2017 |
| CN | 108135413 | A | 6/2018 |
| CN | 108553025 | A | 9/2018 |
| CN | 109044196 | A | 12/2018 |
| CN | 109602326 | A | 4/2019 |
| CN | 109984671 | A | 7/2019 |
| CN | 209153419 | U | 7/2019 |
| CN | 209285374 | U | 8/2019 |
| CN | 211862693 | U | 11/2020 |
| CN | 112401741 | A | 2/2021 |
| EP | 0757902 | A1 | 2/1997 |
| JP | 2010-213935 | A | 9/2010 |
| JP | 2019-118816 | A | 7/2019 |

* cited by examiner

PORTABLE VACUUM CLEANER

CROSS REFERENCE TO RELATED APPLICATIONS

The present application is a 35 U.S.C. § 371 National Phase conversion of International (PCT) Patent Application No. PCT/CN2019/120426, filed on Nov. 22, 2019, which claims benefit of a Chinese Patent Application No. 201910816192.6, filed on Aug. 30, 2019, the disclosure of which is incorporated by reference herein. The PCT International Patent Application was filed and published in Chinese.

TECHNICAL FIELD

The present invention relates to a field of vacuum cleaners, in particular to a portable vacuum cleaner.

BACKGROUND

Existing vacuum cleaners generally use a cyclone separation structure for dust and gas separation. This dust and gas separation structure is very easy to accumulate and wind a lot of dust, cotton wool and other dirt on a filter during a working process. When accumulated dirt needs to be cleaned, a dust cup, a filter and other components need to be disassembled, which is cumbersome to disassemble and prone to errors in assembly. Frequent disassembly and assembly can also easily lead to loose fit of various components, reducing the service life and dust removal effect of the vacuum cleaner. However, during the disassembly and assembly process, the operator's hands are easily contaminated by a large amount of dirt, and the operating space is also easily polluted by dust. In addition, the operations of opening and disassembling the dust cup are cumbersome, and one-key separation from the main body of the vacuum cleaner cannot be achieved, which makes the dust cleaning process cumbersome and takes a lot of time.

In view of this, it is necessary to develop a portable vacuum cleaner to solve the above problems.

SUMMARY

In view of the deficiencies in the prior art, an object of the present invention is to provide a portable vacuum cleaner, which can make the opening of the dust blocking cover and the separation of the dust scraping cylinder and the main body of the vacuum cleaner to be performed simultaneously, by providing the two-way locking mechanism. The original operation process requiring two or more steps is reduced to only one step, which greatly simplifies the operation process and improves the convenience of use of the vacuum cleaner.

In order to achieve the above object and other advantages according to the present invention, a portable vacuum cleaner is provided, including:

a housing and a filter assembly provided in the housing, the housing including:

a dust collecting cylinder, the dust collecting cylinder being hollow inside, and the dust collecting cylinder being opened to form an air inlet port and a mating port at two ends of the dust collecting cylinder;

a dust blocking cover, the dust blocking cover being rotatably connected to the air inlet port of the dust collecting cylinder, so as to open and close the air inlet port;

a dust scraping cylinder, the dust scraping cylinder being hollow, and an end of the dust scraping cylinder being configured to fit with the mating port of the collecting cylinder; and a main body, the main body being hollow inside and detachably connected to the mating port of the dust collecting cylinder;

wherein a two-way locking structure is provided between the dust blocking cover and the main body, the two-way locking structure is adapted to lock or unlock the dust blocking cover and the main body simultaneously with the dust collecting cylinder, so that when the two-way locking structure is in a locked state, the dust blocking cover cannot open the air inlet port, while the dust collecting cylinder and the main body cannot be separated.

Preferably, the two-way locking structure includes:

a locking guide groove, the locking guide groove being formed on an outer side wall of the dust collecting cylinder and extending along an axial direction of the dust collecting cylinder; and two sets of latches symmetrically arranged in the locking guide groove;

wherein the latch is rotatable relative to the locking guide groove to switch between an unlocked state and the locked state; the latch includes a latch body and a latch buckle portion; the latch buckle portion is located outside the locking guide groove; when the latch is in the locked state, the latch buckle portion is buckled with the dust blocking cover or the main body to prevent the latch from being locked; the dust blocking cover opens the air inlet port or prevents the dust collecting cylinder from being separated from the main body.

Preferably, a reset component is elastically connected to each set of the latches; the reset component is arranged in the locking guide groove and acts on the latch; the reset component is elastically deformable; the reset component is adapted to rotate the latch in a locking direction to reset from the unlocked state to the locked state.

Preferably, two sets of latch bases corresponding to the latches are provided in the locking guide groove; a rotating shaft is formed adjacent to a middle section of the latch body; the latch body is rotatably connected with the latch bases through the rotating shaft.

Preferably, the two-way locking structure includes an unlocking assembly; the unlocking assembly acts on the latch body to rotate the latches in an unlocking direction to switch from the locked state to the unlocked state; and the unlocking direction is opposite to the locking direction.

Preferably, the unlocking assembly includes:

a protective cover, the protective cover being covered on the locking guide groove to cover the latch body; and an unlocking block, the unlocking block being slidably embedded in the protective cover;

wherein the unlocking block acts on the latch body to make the latch rotate along the unlocking direction to switch from the locked state to the unlocked state.

Preferably, the dust scraping structure includes a dust scraping cylinder configured to fit with the mating port; the filter assembly includes an air guide pipe, a coarse filter and a fixing cylinder which are connected in sequence along a flow direction of an airflow;

wherein the dust blocking cover is provided with an air extraction port for air extraction; the air guide pipe and the coarse filter are arranged in the dust collecting cylinder, and are arranged at intervals from an inner wall of the dust collecting cylinder; the air guide pipe is sealedly connected to the air extraction port; the fixing cylinder protrudes beyond the mating port and extends into the dust scraping cylinder; an outer side wall of the fixing cylinder is abutted with an inner side wall of the dust scraping cylinder.

Preferably, a dust scraping ring is fixed on a joint of the dust scraping cylinder and the dust collecting cylinder; the dust scraping ring is combined with the dust scraping cylinder at an end of the dust scraping cylinder, and extends from an outer circumference of the dust scraping cylinder toward an inside of the dust collecting cylinder in a tapered manner, so that a diameter of the dust scraping ring is gradually reduced in an extending direction of the dust scraping ring.

Preferably, the dust scraping ring shrinks at an end of the dust scraping ring to form an annular and unclosed dust scraping port; the dust scraping ring is slidably sleeved on the coarse filter through the dust scraping port;

wherein the dust scraping ring maintains elastic contact with an outer side wall of the coarse filter at the dust scraping port.

Preferably, a fine filter chamber and a vacuum generating chamber are provided in the main body in sequence along the flow direction of the airflow; the dust scraping cylinder selectively enters and exits the fine filter chamber; and a vacuum generator is arranged in the vacuum generating chamber.

Compared with the prior art, the present invention has the beneficial effect that the opening of the dust blocking cover and the separation of the dust scraping cylinder and the main body of the vacuum cleaner can be performed simultaneously, by providing the two-way locking mechanism. As a result, the original operation process requiring two or more steps is reduced to only one step, which greatly simplifies the operation process and improves the convenience of use of the vacuum cleaner.

DETAILED DESCRIPTION

Figure 1:
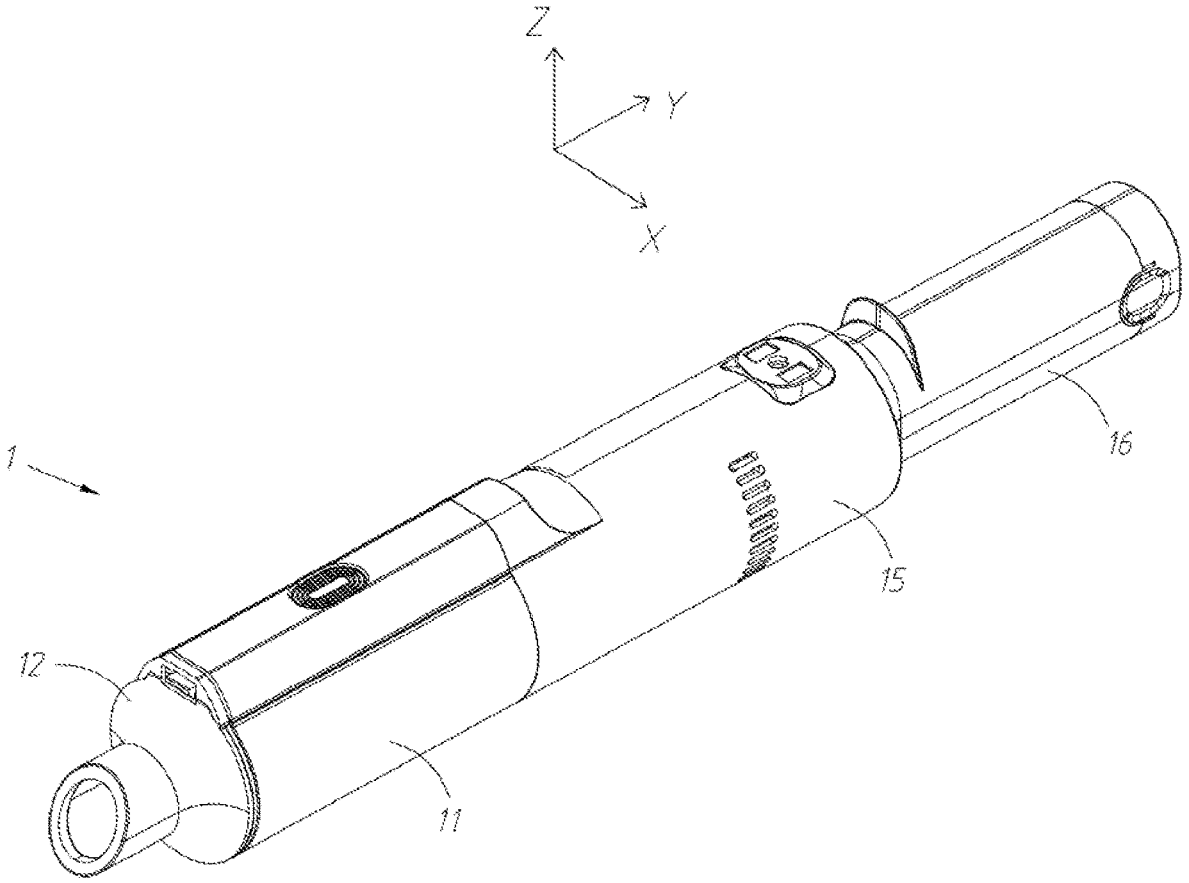
FIG. 1 is a perspective view of a portable vacuum cleaner proposed according to an embodiment of the present invention.

The present invention will be further described in detail below with reference to the accompanying drawings. The foregoing and other objects, features, aspects and advantages of the present invention will become more apparent, so that those skilled in the art can implement them with reference to the description.

In the drawings, the shapes and dimensions may be exaggerated for clarity, and the same reference numerals will be used throughout the drawings to refer to the same or like parts.

In the following description, terms such as center, thickness, height, length, front, back, rear, left, right, top, bottom, upper, lower, etc., are defined relative to the configurations shown in the various drawings. In particular, "height" corresponds to a size from top to bottom, "width" corresponds to a size from left to right, and "depth" corresponds to a size from front to back. They are relative concepts, so they may change according to their different locations and different states of use. Therefore, these and other orientations should not be construed as limiting.

Terms relating to attachment, coupling, etc. (e.g., "connected" and "attached") refer to the fixed or attached relationship as well as the movable or rigid attachment or relationship of these structures, directly or indirectly, to each other through intermediate structures, unless expressly stated otherwise.

Figure 3:
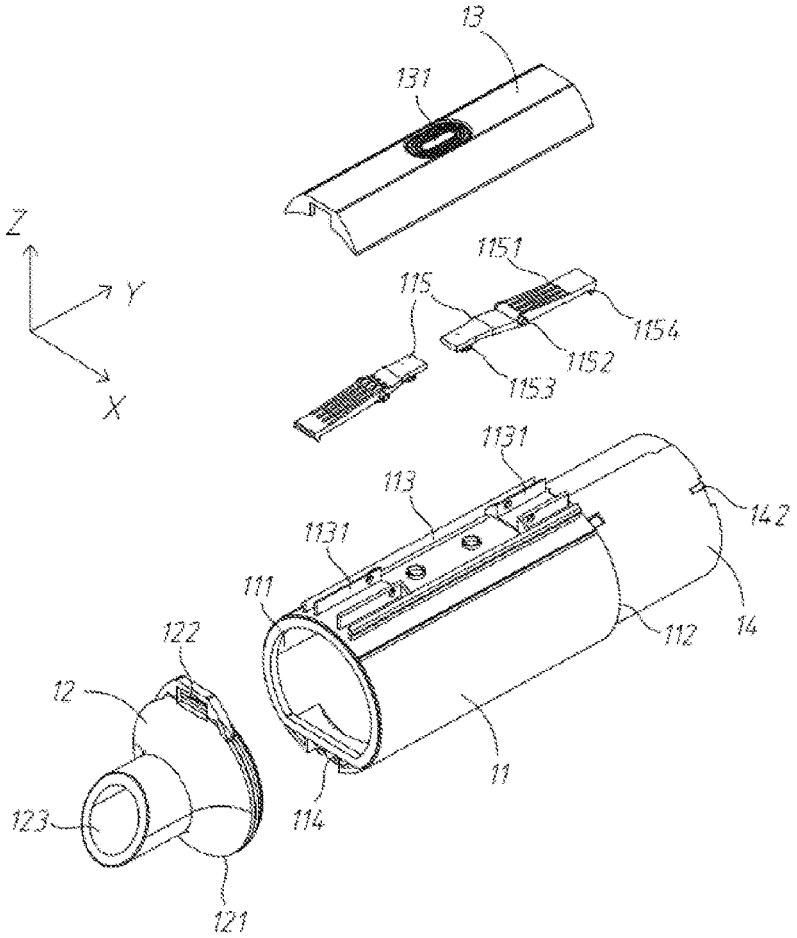
FIG. 3 is an exploded view of a dust scraping structure in a portable vacuum cleaner according to an embodiment of the present invention.
Figure 6:
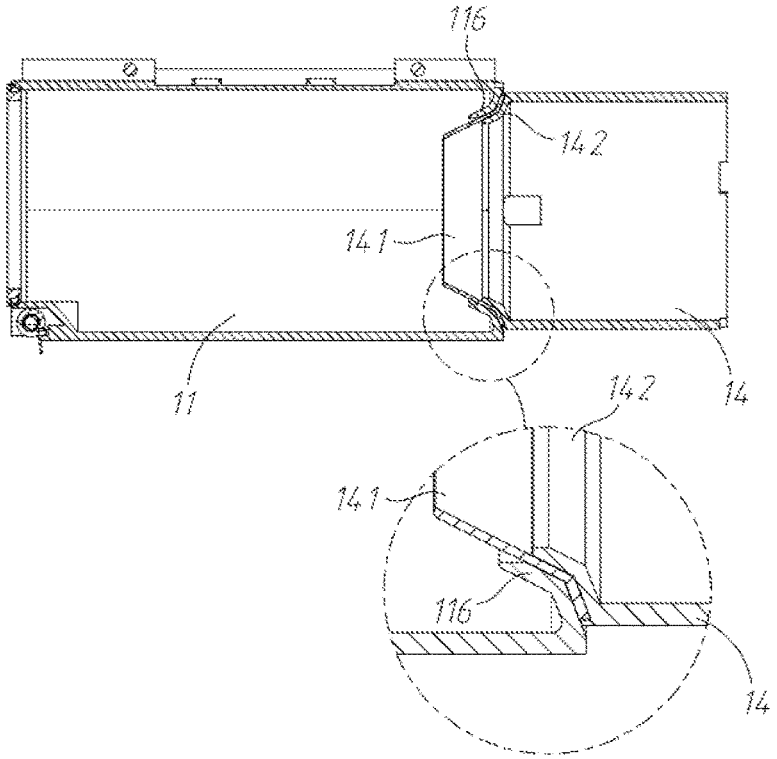
FIG. 6 is a longitudinal cross-sectional view of a dust scraping structure in a portable vacuum cleaner according to an embodiment of the present invention.

According to an embodiment of the present invention, in conjunction with the illustrations in FIG. 3 and FIG. 6, it can be seen that a portable vacuum cleaner includes:

a dust collecting cylinder 11, the dust collecting cylinder 11 being hollow inside, and opened to form an air inlet port 111 and a mating port 112 at two ends of the dust collecting cylinder 11, the mating port 112 being configured to receive a dust scraping structure 14*a*; and a main body 15, the main body 15 being hollow inside and detachably connected to the mating port 112 of the dust collecting cylinder 11;

wherein when the main body 15 is mated with the mating port 112 of the dust collecting cylinder 11, the dust scraping cylinder 14 is coaxially nested in the main body 15; a scraping ring 141 is fixedly connected to the dust scraping cylinder 14 at a joint with the dust collecting cylinder 11.

Figure 7:
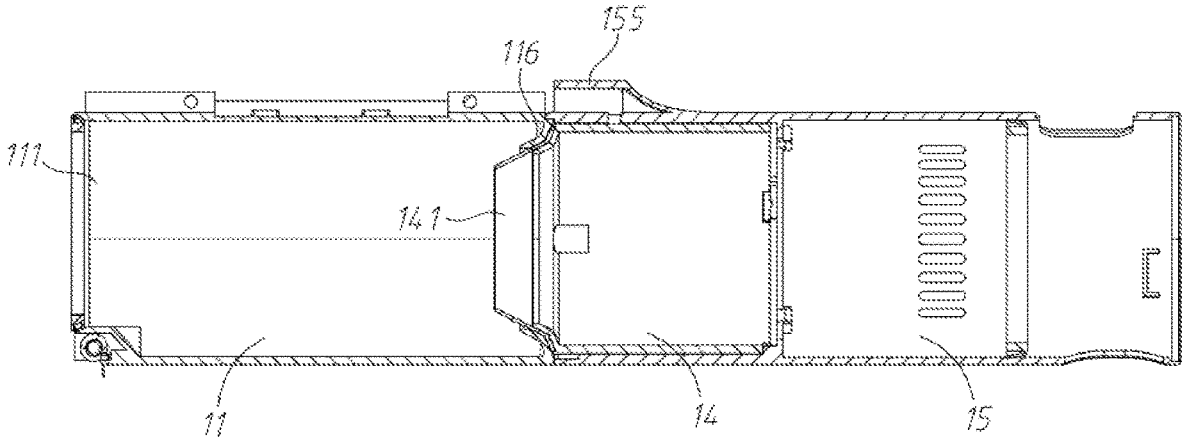
FIG. 7 is a longitudinal cross-sectional view of a dust scraping structure in a portable vacuum cleaner according to another embodiment of the present invention.

Referring now to FIGS. 6 and 7, the dust scraping ring 141 is shown in greater detail. The dust scraping ring 141 is combined with the dust scraping cylinder 14 at an end of the dust scraping cylinder 14. The dust scraping ring 141 extends from an outer circumference of the dust scraping cylinder 14 toward an inside of the dust collecting cylinder 11, so that a diameter of the dust scraping ring 141 is gradually reduced in its extending direction. When removing dust, the dust scraping cylinder 14 is driven by pushing the dust collecting cylinder 11 to drive the dust scraping ring 141 to move linearly, so that the dust scraping ring 141 is wedged into a dirt layer on a filter. The dust scraping ring 141 keeps moving, and then continuously scrapes the dirt on the filter. Repeat the above dust removal action several times until the dirt on the filter is removed. In the dust removal process, the dirt accumulated on the filter can be scraped and cleaned without disassembling the dust and gas separation structure, which is not only simple and easy to operate, but also prevents the operator and the operation space from being polluted, thereby enhancing the ease of cleaning of the vacuum cleaner and the cleanliness during the cleaning process.

A suitable material for the dust scraping ring 141 is any suitable elastic wear-resistant material, such as neoprene, nitrile rubber, silicone, and the like.

Referring to FIG. 6, a reinforcement structure of the dust scraping ring 141 is shown in more detail. An inner support ring 142, which is closely attached to an inner root of the dust scraping ring 141, is formed at a fixed connection between the dust scraping ring 141 and the dust scraping cylinder 14. In addition, an outer support ring 116 is formed at a junction of the dust collecting cylinder 11 and the dust scraping cylinder 14, which is closely attached to an outer root of the dust scraping ring 141. Through the sandwich-like structure of the inner support ring 142 and the outer support ring 116, the roots of the dust scraping ring 141 are clamped to the inner support ring 142 and the outer support ring 116, which can increase the stability of the dust scraping ring 141, thereby preventing the dust scraping ring 141 from being bent or even broken during the dust removal process, and improving the durability of the dust scraping ring 141. In addition, the dust scraping ring 141 is fixed without the need for additional attachments (e.g., screws, bolts, etc.). This reduces the overall part count of the scraper structure, while also reducing overall weight and assembly complexity.

Referring to FIG. 7, it can be noted that an outer side wall of the scraper cylinder 14 is slidably connected with an inner side wall of the main body 15.

Further, a guiding structure for guiding the movement path of the dust scraping cylinder 14 is further provided between the dust scraping cylinder 14 and the main body 15.

Figure 2:
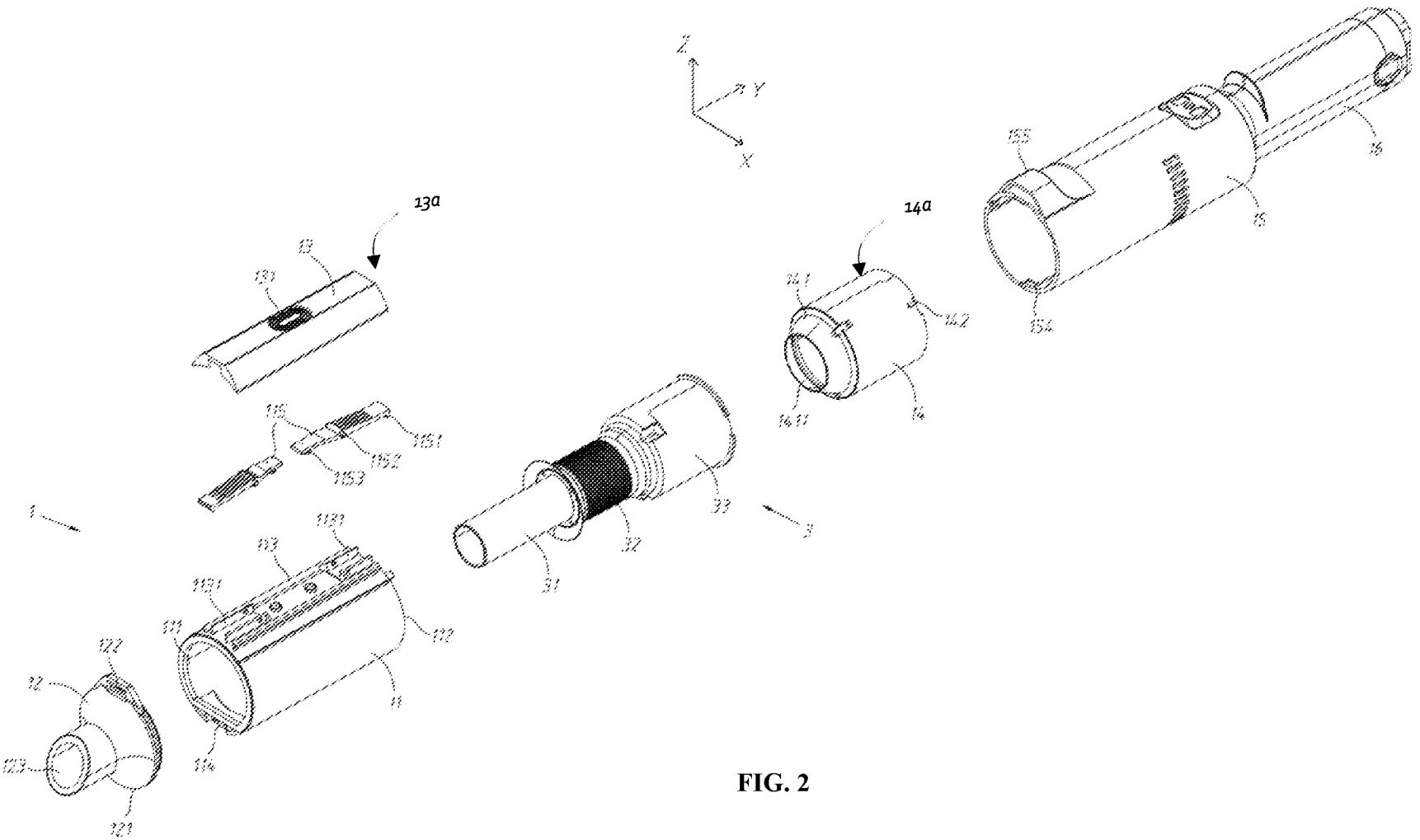
FIG. 2 is an exploded view of a portable vacuum cleaner proposed according to an embodiment of the present invention.

Referring to FIG. 2 firstly, wherein the guiding structure is shown in greater detail. The guiding structure includes:

- a guide path 154, the guide path 154 being provided on the outer side wall of the scraper cylinder 14 or the inner side wall of the main body 15; and
- a guide terminal 142, the guide terminal 142 being provided on the inner side wall of the main body 15 or the outer side wall of the dust scraping cylinder 14;
- wherein when the scraper cylinder 14 is nested in the main body 15, the guide terminal 142 keeps matching with the guide path 154.

Figure 8:
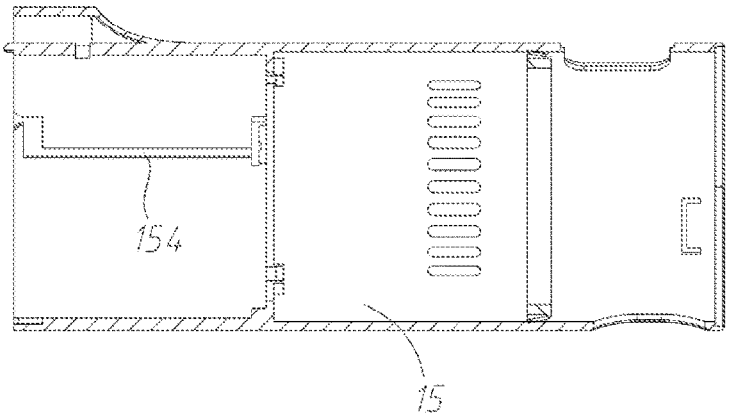
FIG. 8 is a longitudinal cross-sectional view of a main body in a portable vacuum cleaner according to an embodiment of the present invention.
Figure 9:
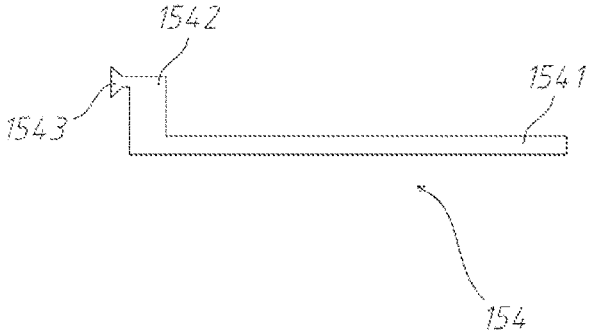
FIG. 9 is a front view of a guide path in a portable vacuum cleaner according to an embodiment of the present invention.

Referring to FIGS. 8 and 9, the guide path 154 is shown in greater detail. The guide path 154 includes:

- a guiding section 1541, an extending direction of the guiding section 1541 being parallel to an axis of the dust scraping cylinder 14 or an axis of the main body 15;
- an unlocking section 1542, one end of the unlocking section 1542 communicating with one end of the guiding section 1541; and
- a lead-in section 1543, one end of the lead-in section 1543 communicating with the other end of the unlocking section 1542;
- wherein an extending direction of the lead-in section 1543 is consistent with an extending direction of the guiding section 1541; and the unlocking section 1542 is perpendicular to the lead-in section 1543 or the guiding section 1541.

Referring again to FIG. 2, in a preferred embodiment, the guide terminal 142 is provided on the outer side wall of a distal end of the scraper cylinder 14. In addition, three guide terminals 142 are provided at equal intervals in a circumferential direction of the scraper cylinder 14. Three guide paths 154 are provided at equal distances in the circumferential direction of the inner side wall of the main body 15. Moreover, the lead-in section 1543 leads to the outside of the main body 15 along its extending direction and is opposite to the mating port 112.

The basic structure of the guiding structure has been fully described above, and it is understandable to those skilled in the art its mating process as follows: when the dust scraping cylinder 14 is to be connected with the dust collecting cylinder 11, the guide terminal 142 is aligned with an entrance of the lead-in section 1543, and a distance between the scraper cylinder 14 and the dust collecting cylinder 11 is gradually shorten until the guide terminal 142 completes the lead-in section 1543; then, the dust collecting cylinder 11 is rotated by a corresponding angle along the extending direction of the unlocking section 1542 until the guide terminal 142 completes the unlocking section 1542; then, the distance between the dust scraping cylinder 14 and the dust collecting cylinder 11 is continued to be shorten, the guide terminal 142 is pushed to complete the guiding section 1541, and finally the dust scraping cylinder 14 and the dust collecting cylinder 11 are made to abut against each other. Conversely, when it is desired to separate the dust scraping cylinder 14 from the dust collecting cylinder 11, the guide terminal 142 is gradually withdrawn from the guide path 154 along a direction opposite to the mating direction, which is limited in space and will not be repeated here.

According to an embodiment of the present invention, in conjunction with the illustrations in FIG. 1, FIG. 2, FIG. 4 and FIG. 5, it can be seen that the portable vacuum cleaner includes:

- a housing 1, which is hollow inside; and
- a filter assembly 3 arranged in the housing 1;
- wherein the housing 1 includes the dust scraping structure described in any one of the above embodiments.

Furthermore, the housing 1 includes:

- a dust blocking cover 12, the dust blocking cover 12 being rotatably connected to the air inlet port 111 of the dust collecting cylinder 11 to open and close the air inlet port 111;
- a main body 15, the main body 15 being hollow inside and detachably connected to the mating port 112 of the dust collecting cylinder 11; and
- a holding cylinder 16, the holding cylinder 16 being opposite to the other end of the main body 15;
- wherein the dust blocking cover 12 is provided with an air extraction port 123 for air extraction; when the main body 15 is mated with the mating port 112 of the dust collecting cylinder 11, the dust scraping cylinder 14 is coaxially nested in the main body 15.

Referring to FIG. 2 again, the dust blocking cover 12 is rotatably connected to a hinge portion 114 on the air inlet port 111 through the connecting portion 121 thereon, wherein the dust blocking cover 12 is provided with a clamping groove 122 opposite to the connecting portion 121.

Figure 4:
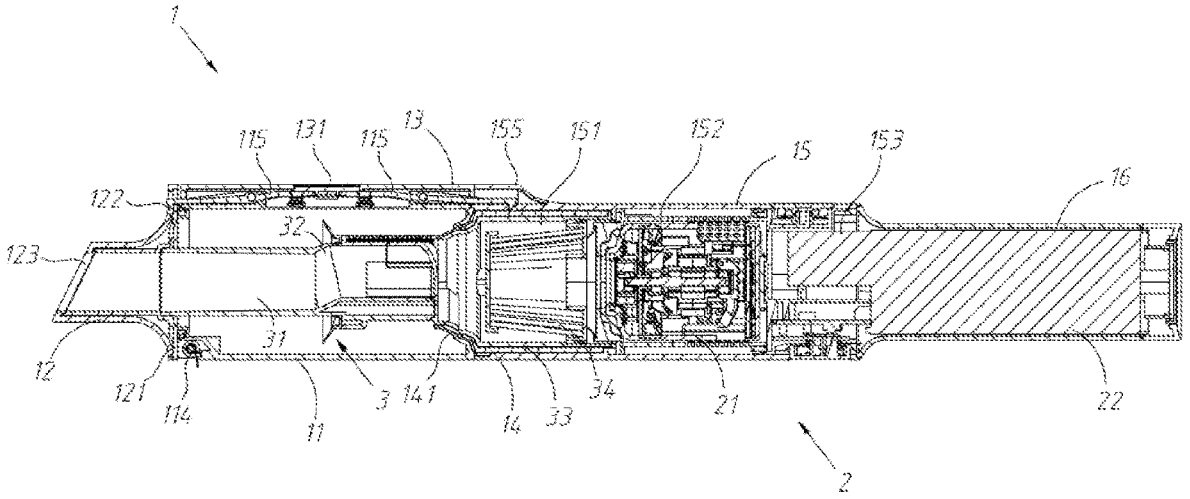
FIG. 4 is a longitudinal cross-sectional view of a portable vacuum cleaner according to an embodiment of the present invention.
Figure 5:
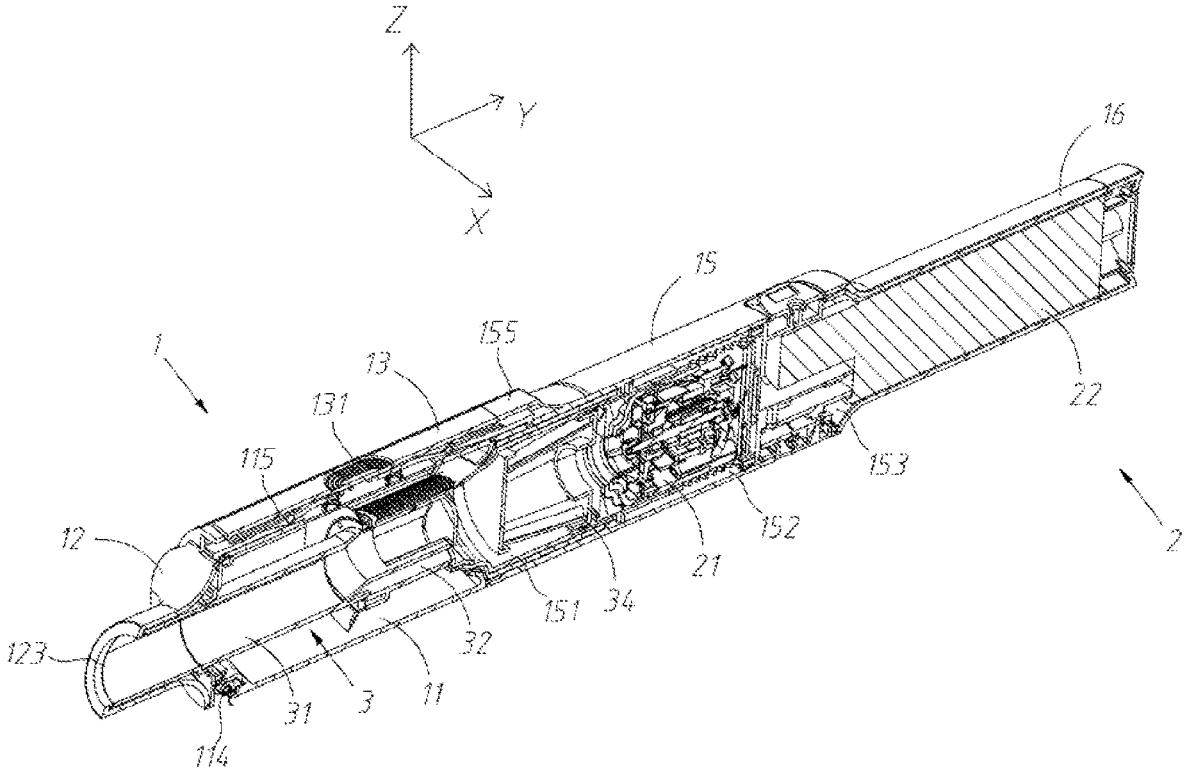
FIG. 5 is a longitudinal cross-sectional view of a portable vacuum cleaner according to an embodiment of the present invention in a perspective view.

Referring to FIG. 2, FIG. 4 and FIG. 5, the dust scraping structure **14*a* includes a dust scraping cylinder 14 configured to fit with the mating port 112. The filter assembly 3 includes an air guide pipe 31, a coarse filter 32 and a fixing cylinder 33** which are connected in sequence along a flow direction of an airflow;

- wherein the air guide pipe 31 and the coarse filter 32 are arranged in the dust collecting cylinder 11, and are arranged spaced apart from the inner wall of the dust collecting cylinder 11. The air guide pipe 31 is sealedly connected to the air extraction port 123. The fixing cylinder 33 protrudes beyond the mating port 112 and extends into the scraping cylinder 14. The outer side wall of the fixing cylinder 33 is abutted with the inner side wall of the dust scraping cylinder 14.

Furthermore, a fine filter 34 is provided in the fixing cylinder 33. The air filtered by the coarse filter 32 will flow through the fine filter 34 and be filtered again by the fine filter 34 to improve the cleanliness of the air.

In a preferred embodiment, the fine filter 34 is a HEPA filter.

Referring to FIG. 2, the dust scraping ring 141 shrinks at its end to form an annular and unclosed dust scraping port 1411. The dust scraping ring 141 is slidably sleeved on the coarse filter 32 through the dust scraping port 1411.

The dust scraping ring 141 is in elastic contact with the outer side wall of the coarse filter 32 at the dust scraping port 1411.

Referring to FIGS. 4 and 5, when the dust scraping cylinder 14 is mated with the dust collecting cylinder 11, the dust scraping ring 141 is located in a transition section between the coarse filter 32 and the fixing cylinder 33. The dust scraping port 1411 does not block the filter port of the coarse filter 32, and will not affect the cyclone dust and gas separation operation of the coarse filter. When removing dust, the dust scraping cylinder 14 is driven by pushing the dust collecting cylinder 11 to drive the dust scraping ring 141 to move linearly along the outer surface of the coarse filter 32. This causes the dust scraping ring 141 to wedge into the dirt layer on the coarse filter 32. The dust scraping ring 141 keeps moving, and then continuously scrapes the dirt on the coarse filter 32. The above-mentioned dust removal operation is repeated many times until the dirt on the coarse filter 32 is removed. The removed dirt is collected in the dust collecting cylinder 11. After cleaning, the dust blocking cover 12 is opened, and the hanging dust can be poured out through the air inlet port 111 for cleaning. After cleaning, the dust blocking cover 12 is closed. In the dust removal process, the dirt accumulated on the filter can be scraped and cleaned without disassembling the dust and gas separation structure. This is not only simple and easy to operate, but also the operator and the operating space will not be polluted, which enhances the cleanability of the vacuum cleaner and the cleanliness during the cleaning process.

In a preferred embodiment, the dust scraping ring 141 is made of an elastic material, so that the dust scraping ring 141 can always keep in close contact with the coarse filter 32 during the scraping process, thereby improving the scraping efficiency.

Referring now again to FIG. 2, there is shown a two-way locking structure provided on the outer side wall of the dust collecting cylinder 11. The two-way locking structure includes:

- a locking guide groove 113, the locking guide groove 113 being formed on an outer side wall of the dust collecting cylinder 11 and extending along a length direction of the dust collecting cylinder 11; and
- two sets of latches 115, the latches 115 being symmetrically arranged in the locking guide groove 113;
- wherein the latch 115 is rotatable relative to the locking guide groove 113 to switch between an unlocked state and a locked state; the latch 115 includes a latch body 1151 and a latch buckle portion 1154; the latch buckle portion 1154 is located outside the locking guide groove 113; when the latch 115 is in the locked state, the latch buckle portion 1154 is buckled with the dust blocking cover 12 or the main body 15 to prevent the dust blocking cover 12 from opening the air inlet port 111, or prevent the dust collecting cylinder 11 from being separated from the main body 15.

Furthermore, each set of the latches 115 is elastically connected with a reset component 1153. The reset component 1153 is disposed in the locking guide groove 113 and acts on the latch 115. The reset component 1153 is elastically deformable. The reset component 1153 is adapted to rotate the latch 115 in a locking direction to reset from the unlocked state to the locked state.

Furthermore, two sets of latch bases 1131 corresponding to the latches 115 are arranged in the locking guide groove 113. A rotating shaft 1152 is formed near a middle section of the latch body 1151. The latch body 1151 is rotatably connected to the latch base 1131 through the rotating shaft 1152. In a preferred embodiment, the reset component 1153 adopts a restoring spring which elastically resists between a bottom wall of the locking guide groove 113 and the latch body 1151. Wherein the reset component 1153 is disposed opposite to the latch buckle portion 1154.

When the dust scraping cylinder 14 is mated with the dust collecting cylinder 11, the latch buckle portions 1154 of one set of the latches 115 are latched with the main body 15. As a preferred embodiment, a receiving cover 155 for allowing the latch buckle portion 1154 to go in and out is provided on a cover where the latch buckle portion 1154 is engaged with the main body 15.

Furthermore, the two-way locking structure includes an unlocking assembly **13*a*. The unlocking assembly 13*a* acts on the latch body 1151 to rotate the latch 115** in the unlocking direction to switch from the locked state to the unlocked state. The unlocking direction is opposite to the locking direction.

Referring now to FIGS. 2 and 4, the unlocking assembly **13*a* is shown in greater detail. The unlocking assembly 13*a*** includes:

- a protective cover 13, the protective cover 13 being placed on the locking guide groove 113 to cover the latch body 1151;
- an unlocking block 131, the unlocking block 131 being slidably embedded in the protective cover 13;
- wherein the unlocking block 131 acts on the latch body 1151 to make the latch 115 rotate along the unlocking direction to switch from the locked state to the unlocked state. When the unlocking block 131 is pressed down, the unlocking block 131 simultaneously acts on the respective latch bodies 1151 of the two latches 115, so that the two latches 115 rotate along the unlocking direction to unlock the dust blocking cover 12 and the main body 15 at the same time, therefore the dust scraping operation can be performed in the unlocked state. After the dust scraping operation is completed, when the dust blocking cover 12 is reset and the main body 15 is mated with the dust collecting cylinder 11 again, the pressed unlocking block 131 is released. This makes the two latches 115 rotate along the locking direction to lock the dust blocking cover 12 and the main body 15 at the same time, so that the dust removal operation can be continued.

Referring to FIG. 4 and FIG. 5, the main body 15 is provided with a fine filter chamber 151 and a vacuum generating chamber 152 which are sequentially communicated along the flow direction of the airflow. The scraping cylinder 14 selectively enters and exits the fine filter chamber 151. A vacuum generator 21 is provided in the vacuum generating chamber 152.

Furthermore, the holding cylinder 16 is provided with a battery 22. The main body 15 is provided with a connecting chamber 153 opposite to the holding cylinder 16. Electrode ends of the battery 22 are inserted into the connecting chamber 153 and electrically connected to the vacuum generator 21.

The number of apparatuses and processing scales described here are intended to simplify the description of the present invention. Applications, modifications and variations to the present invention will be apparent to those skilled in the art.

Although the embodiments of the present invention have been disclosed above, they are not limited to the applications listed in the description and the embodiments, and can be applied to various fields suitable for the present invention. Additional modifications can readily be implemented by those skilled in the art. Therefore, the present invention is not to be limited to the specific details and illustrations herein shown and described, without departing from the general concept defined by the appended claims and the scope of equivalents.

The invention claimed is:

1. A portable vacuum cleaner, comprising: a housing and a filter assembly provided in the housing, the housing comprising:

a dust collecting cylinder, the dust collecting cylinder being hollow inside, and the dust collecting cylinder being opened to form an air inlet port and a mating port each at ends of the dust collecting cylinder, the mating port being configured to receive a dust scraping structure;

a dust blocking cover, the dust blocking cover being rotatably connected to the air inlet port of the dust collecting cylinder, so as to open and close the air inlet port; and a main body, the main body being hollow inside and detachably connected to the mating port of the dust collecting cylinder;

wherein a two-way locking structure is provided between the dust blocking cover and the main body, the two-way locking structure is adapted to lock or unlock the dust blocking cover and the main body simultaneously with the dust collecting cylinder, so that when the two-way locking structure is in a locked state, the dust blocking cover cannot open the air inlet port, while the dust collecting cylinder and the main body cannot be separated.

2. The portable vacuum cleaner according to claim 1, wherein the two-way locking structure comprises:

a locking guide groove, the locking guide groove being formed on an outer side wall of the dust collecting cylinder and extending along an axial direction of the dust collecting cylinder; and two sets of latches symmetrically arranged in the locking guide groove;

wherein the latch is rotatable relative to the locking guide groove to switch between an unlocked state and the locked state; the latch comprises a latch body and a latch buckle portion; the latch buckle portion is located outside the locking guide groove; when the latch is in the locked state, the latch buckle portion is buckled with the dust blocking cover or the main body to prevent the latch from being locked; the dust blocking cover opens the air inlet port or prevents the dust collecting cylinder from being separated from the main body.

3. The portable vacuum cleaner according to claim 2, wherein a reset component is elastically connected to each set of the latches; the reset component is arranged in the locking guide groove and acts on the latch; the reset component is elastically deformable; the reset component is adapted to rotate the latch in a locking direction to reset from the unlocked state to the locked state.

4. The portable vacuum cleaner according to claim 3, wherein two sets of latch bases corresponding to the latches are provided in the locking guide groove; a rotating shaft is formed adjacent to a middle section of the latch body; the latch body is rotatably connected with the latch bases through the rotating shaft.

5. The portable vacuum cleaner according to claim 3, wherein the two-way locking structure comprises an unlocking assembly; the unlocking assembly acts on the latch body to rotate the latches in an unlocking direction to switch from the locked state to the unlocked state; and the unlocking direction is opposite to the locking direction.

6. The portable vacuum cleaner according to claim 5, wherein the unlocking assembly comprises:

a protective cover, the protective cover configured over the locking guide groove and the latch body; and an unlocking block, the unlocking block being slidably embedded in the protective cover;

wherein the unlocking block of the unlocking assembly acts on the latch body to make the latch rotate along the unlocking direction to switch from the locked state to the unlocked state.

7. The portable vacuum cleaner according to claim 1, wherein the dust scraping structure comprises a dust scraping cylinder configured to fit with the mating port; the filter assembly comprises an air guide pipe, a coarse filter and a fixing cylinder which are connected in sequence along a flow direction of an airflow;

wherein the dust blocking cover is provided with an air extraction port for air extraction; the air guide pipe and the coarse filter are arranged in the dust collecting cylinder, and are arranged at intervals from an inner wall of the dust collecting cylinder; the air guide pipe is sealedly connected to the air extraction port; the fixing cylinder protrudes beyond the mating port and extends into the dust scraping cylinder; an outer side wall of the fixing cylinder is abutted with an inner side wall of the dust scraping cylinder.

8. The portable vacuum cleaner according to claim 7, wherein a dust scraping ring is fixed on a joint of the dust scraping cylinder and the dust collecting cylinder; the dust scraping ring is combined with the dust scraping cylinder at an end of the dust scraping cylinder, and extends from an outer circumference of the dust scraping cylinder toward an inside of the dust collecting cylinder in a tapered manner, so that a diameter of the dust scraping ring is gradually reduced in an extending direction of the dust scraping ring.

9. The portable vacuum cleaner according to claim 7, wherein the dust scraping ring converges at one end to form an annular, unclosed dust scraping port; the dust scraping ring is sleeved over the coarse filter through the dust scraping port;

wherein the dust scraping ring maintains elastic contact with an outer side wall of the coarse filter at the dust scraping port.

10. The portable vacuum cleaner according to claim 7, wherein a fine filter chamber and a vacuum generating chamber are provided in the main body in sequence along the flow direction of the airflow; the dust scraping cylinder selectively enters and exits the fine filter chamber; and a vacuum generator is arranged in the vacuum generating chamber.

* * * * *